US006002217A

United States Patent [19]

Stevens et al.

[11] Patent Number: 6,002,217

[45] Date of Patent: Dec. 14, 1999

[54] DOOR OPERATING SYSTEM

[75] Inventors: James C. Stevens, Mooresville; Robert Utterback, Indianapolis, both of Ind.; James D. Rhoads, Reading, Pa.

[73] Assignee: Dorma Door Controls, Inc., Reamstown, Pa.

[21] Appl. No.: 08/914,450

[22] Filed: Aug. 19, 1997

[51] Int. Cl.[6] ..... H02K 7/10

[52] U.S. Cl. ..... 318/9; 49/340; 49/139

[58] Field of Search ..... 318/3, 12, 9, 14, 318/15, 280–300, 446–489; 49/124, 139–140, 324–363

[56] References Cited

U.S. PATENT DOCUMENTS

| | | | |
|---|---|---|---|
| 1,684,704 | 9/1928 | Hubbell . | |
| 2,256,613 | 9/1941 | Forman et al. . | |
| 3,127,160 | 3/1964 | Wallmann . | |
| 3,129,936 | 4/1964 | Carlson . | |
| 3,874,117 | 4/1975 | Boehm | 49/264 |
| 4,040,144 | 8/1977 | Lasier et al. | 16/66 |
| 4,220,051 | 9/1980 | Catlett | 74/89 |
| 4,222,147 | 9/1980 | Burnett, Jr. | 16/62 |
| 4,261,440 | 4/1981 | Jacoby . | |
| 4,339,842 | 7/1982 | Fontana et al. | 16/32 |
| 4,348,835 | 9/1982 | Jones et al. | 49/139 |
| 4,429,490 | 2/1984 | Zunkel | 49/32 |
| 4,727,679 | 3/1988 | Kornbrekke et al. | 49/138 |
| 4,793,023 | 12/1988 | Simpson et al. | 16/58 |
| 4,831,509 | 5/1989 | Jones et al. | 318/466 |
| 4,952,080 | 8/1990 | Boiucaner et al. | 388/811 |
| 4,995,194 | 2/1991 | Schultze et al. | 49/32 |
| 5,040,331 | 8/1991 | Merendino et al. . | |

FOREIGN PATENT DOCUMENTS

| | | |
|---|---|---|
| 0632181 | 1/1995 | European Pat. Off. . |
| 3730114 | 5/1988 | Germany . |
| 4124282 | 1/1993 | Germany . |
| 4323150 | 1/1995 | Germany . |
| 475073 | 11/1937 | United Kingdom . |
| 8911578 | 11/1989 | WIPO . |

*Primary Examiner*—David Martin
*Attorney, Agent, or Firm*—Reed Smith Shaw & McClay, LLP

[57] ABSTRACT

The present invention relates to a door operating system for controlling the movement of a door, the system having a motor with a motor shaft for providing rotational energy to the system and a gear chain assembly for receiving the rotational energy from the motor shaft and applying the received rotational energy to the door to move the door, comprising a sprocket rotatably mounted on the gear chain assembly for rotation around an axis of the gear chain assembly and fixedly coupled to the motor shaft for receiving and transmitting the rotational energy from the motor shaft; a drive pin fixedly disposed on the sprocket for rotational movement around the axis of the gear chain assembly as the sprocket rotates around the axis; a rotational energy receiving extension rotatably mounted on the gear chain assembly and drivingly coupled to the door for moving the door; a drive dog fixedly disposed on the energy receiving extension for rotational movement around the axis of the gear chain assembly as the energy receiving extension rotates around the axis; and the sprocket and the extension being disposed on the gear chain assembly such that rotational movement of the sprocket causes the drive pin to rotatably move into contact with the drive dog and apply rotational energy to the drive dog thereby transmitting rotational energy to the door when rotating in one direction and moving away from the drive dog when rotating in the other direction.

1 Claim, 13 Drawing Sheets

A
RUN MOTOR OPEN IS SPROCKET AT POSITION?
NO
704
YES
706
PUSH
PUSH OR PULL?
PULL
READ ANGLE POT. DIVIDE BY 8
710
0 – 32 POSSIBLE
READ ANGLE POT. DIVIDE BY 8
718
0 – 32 POSSIBLE
ADD 1 POINT FOR EVERY 4 ADD OFFSET
714
ADD 1 POINT FOR EVERY 4 ADD OFFSET
722
B

No Obstacles
40 lb Door

No Obstacles
150 lb Door 8 lb Obstacle
40 lb Door 10 lb Obstacle
150 lb Door

DOOR OPERATING SYSTEM

FIELD OF THE INVENTION

This invention relates to an apparatus and method for continuously monitoring and controlling the operation of a door, and, more particularly, it relates to a self-adjusting apparatus and method for opening and closing a door.

BACKGROUND OF THE INVENTION

Hydraulic and pneumatic door closures for controlling closing characteristics of swing doors are well known and have been widely used. See, for example, U.S. Pat. Nos. 4,793,023, 4,414,703 and 4,378,612. Primarily hydraulically, pneumatically operated openers, or opening assist mechanisms are also known. U.S. Pat. Nos. 3,948,000, 3,936,977, 4,955,194 and 4,429,490 teach such mechanisms. Additionally, a variety of electromechanical automatic door operators are known. See, for example, U.S. Pat. Nos. 2,910,290, 3,127,160, 4,045,914 and 4,220,051. Each type of door opener, hydraulic, pneumatic and electromechanical, has its own advantages and disadvantages.

It has also been known to combine these mechanisms in order to obtain some of the advantages of each. See, for example, U.S. Pat. Nos. 3,874,117, 3,129,936, 1,684,704, 2,256,613, and 4,438,835. This approach to making door controllers has sometimes included using an hydraulic mechanism merely as a speed controller rather than as an independently functioning unit. This approach is not entirely satisfactory due to a lack of attractiveness and additional space requirements adjacent to the door. Additionally, the expense of manufacture and operation is relatively high for some combinations. For example, when a clutch or other disengagement mechanism is required for operation, the resulting system can be too expensive for economical use. Furthermore, excessive control complexity may be required to achieve reliability and to meet door operating standards for some combinations.

Previous door operating systems required an individual to perform calibrations to monitor the movement and location of a door. Installation of such door systems were tedious, cumbersome and time consuming because most door system computers did not know the location of the door or were not able to continuously monitor the movement of the door. In addition, most door operating systems did not have any features that accommodated obstacles and the changing conditions of obstacles. For example, a carpet underneath a door operated by such a system can be flat, shaggy, etc. and can undergo numerous changes based on heat, moisture, etc. When wet, the carpet is flatter and movement of the door is easier. When dry and hot, the carpet material has a propensity to expand and movement of the door may be restricted. The prior art door systems could not self-adjust to these conditions.

In addition, most door operating systems are not able to function during power outages. Since most door operating system situated in public facilities such as hospitals, the loss of power renders these door systems paralyzed and useless. The present invention addresses these problems by providing an improved door operating system.

OBJECTS OF THE INVENTION

One of the objects of the present invention is to provide an apparatus and method for continuously monitoring and controlling the operation of a door.

Another object of the invention is to provide a self-adjusting apparatus and method for opening and closing a door.

A further object of the present invention is to provide a method for sensing an obstacle restricting the movement of a door.

Yet another object of the present invention is to provide a door operating system with an energy storage device.

Still another object of the present invention is to provide a door operating system that is low cost and require low energy.

SUMMARY OF THE INVENTION

The present invention is a method for sensing obstacles restricting movement of a door having door opening cycles in a system utilizing a door control device. The method includes providing a reference operating value according to previous door opening cycles and determining a current door operating value according to a current door opening cycle. The current door operating value is compared with the reference door operating value and the movement of the door is controlled by the door control device according to the comparison. The reference operating value can be an average of a plurality of values or a range of values. The method includes the further step of stopping the movement of the door and opening the door in response to the comparison. In another embodiment, the method includes the further step of stopping the movement of the door and closing the door in response to the comparison.

The door control system of the present invention has a door control device for moving the door and an energy source for energizing the door control device. Energy is stored in an energy storage device so that when an interruption in the energy source is detected, the energy stored in the energy storage device is applied to the door operator in response to the detection. The energy storage device can be a capacitor. The door operating system also has a motor with a motor shaft for providing rotational energy to the system and a gear chain assembly for receiving the rotational energy from the motor shaft and applying the received rotational energy to the door to move the door. The gear chain assembly includes a sprocket rotatably mounted on the gear chain assembly for rotation around an axis of the gear chain assembly and is fixedly coupled to the motor shaft for receiving the rotational energy from the motor shaft. The gear chain assembly also includes a drive pin fixedly disposed on the sprocket for rotational movement around the axis of the gear chain assembly as the sprocket rotates around the axis. A rotational energy receiving extension is rotatably mounted on the gear chain assembly and drivingly coupled to the door for moving the door. A drive dog is fixedly disposed on the energy receiving extension for rotational movement around the axis of the gear chain assembly as the extension rotates around the axis. The sprocket and the extension are disposed on the gear chain assembly such that rotational movement of the sprocket causes the drive pin to rotatably move into contact with the drive dog to apply rotational energy to the drive dog thereby transmitting rotational energy to the door when rotating in one direction and moving apart from the drive dog when rotating in the other direction.

The system has a source of mechanical energy and an energy transmission device coupled to the door. The mechanical energy is applied to the energy transmission device for moving the door. A sensor is provided for determining the position of the energy transmission device.

The sensors of the door operating system can continuously monitor the position of the energy transmission device and can further include a door closer having a door closer shaft. The sensor can be a potentiometer. The door system includes a drive sprocket detachably coupled to the energy transmission device and further comprises a sensor for sensing the position of the drive sprocket and providing independent monitoring of the energy transmission device and drive sprocket. The additional sensor can also be a potentiometer.

BRIEF DESCRIPTION OF THE DRAWINGS

A more complete appreciation of the present invention and many of the attendant advantages thereof will be readily understood by reference to the following description when considered in connection with the accompanying drawings in which.

DETAILED DESCRIPTION OF THE PREFERRED EMBODIMENTS

Figure 1:
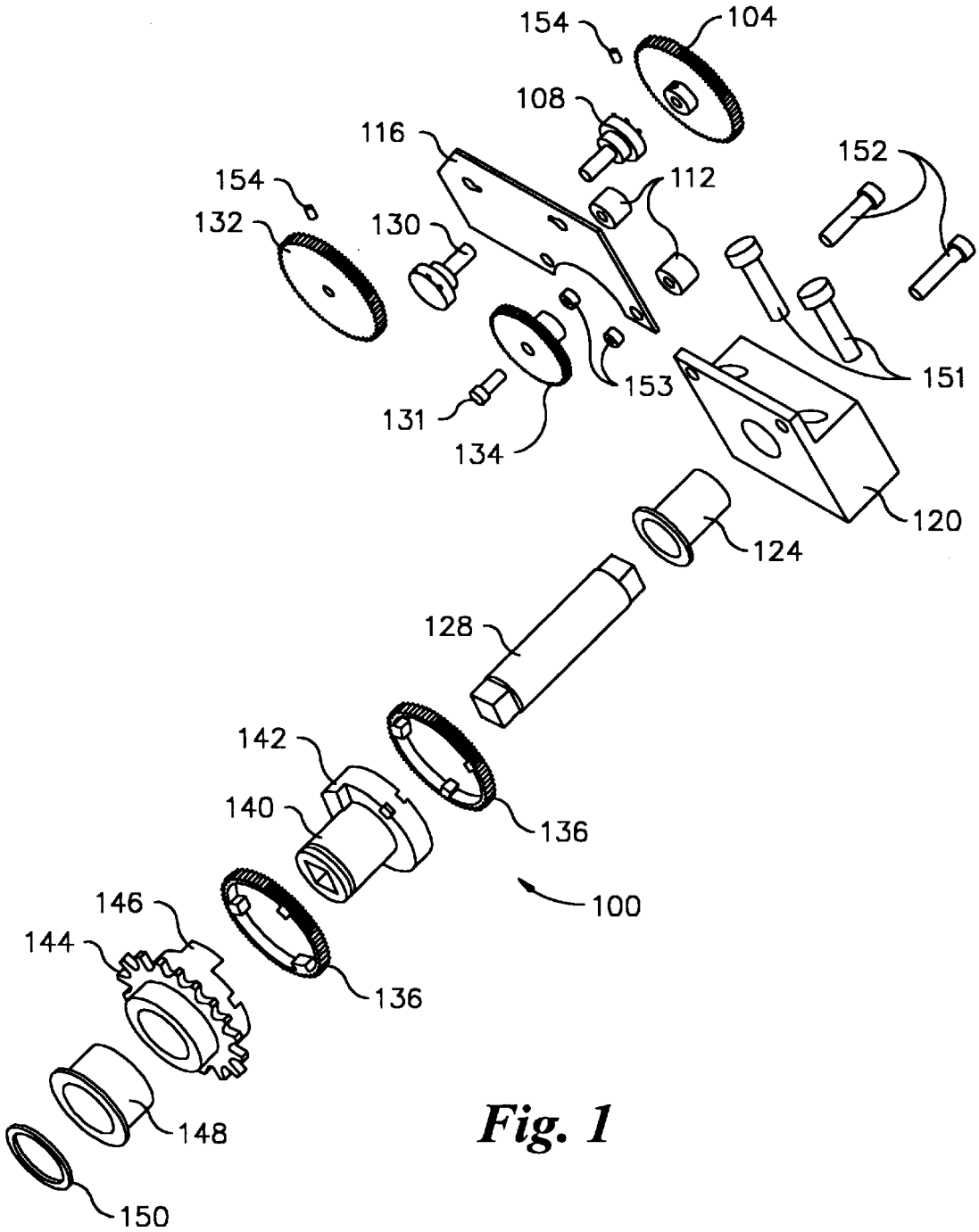
FIGS. 1–4 are exploded views of the door operator system of the present invention.
Figure 2:
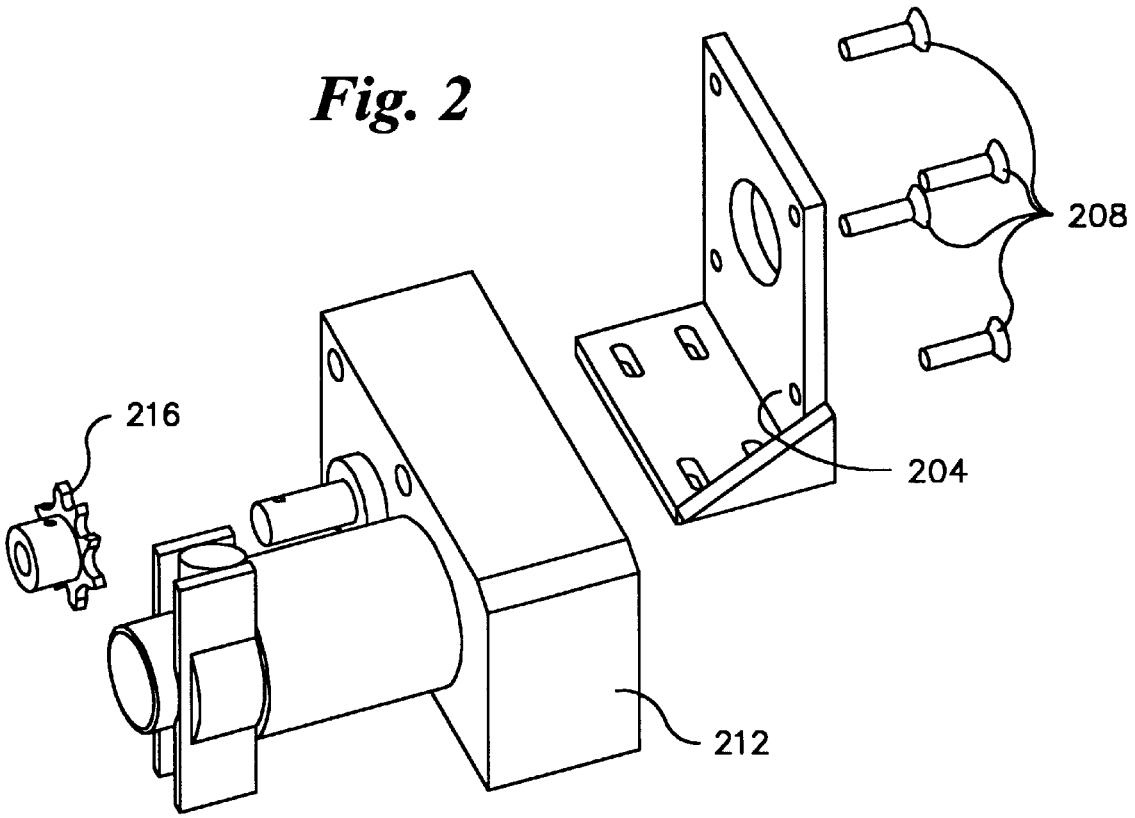
Figure 3:
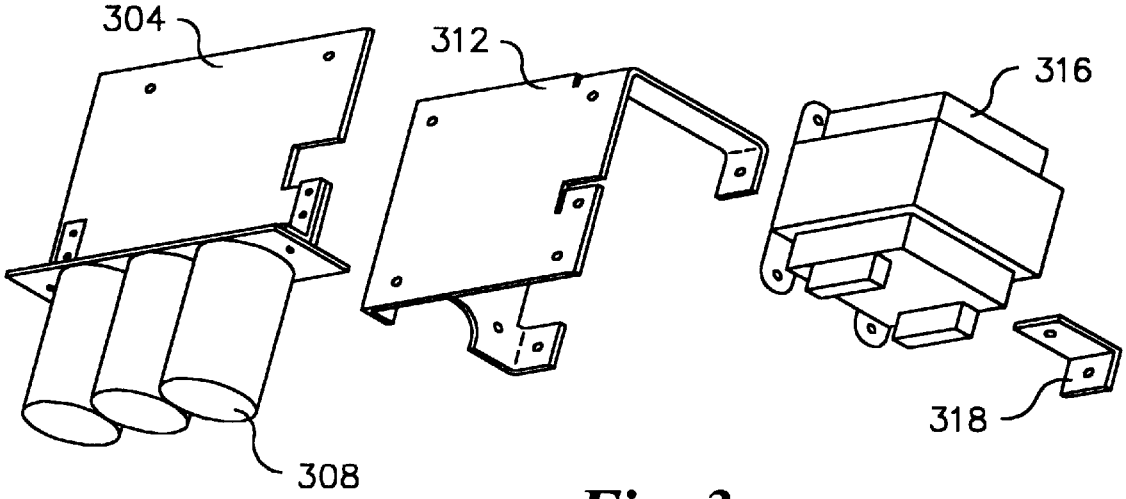
Figure 4:
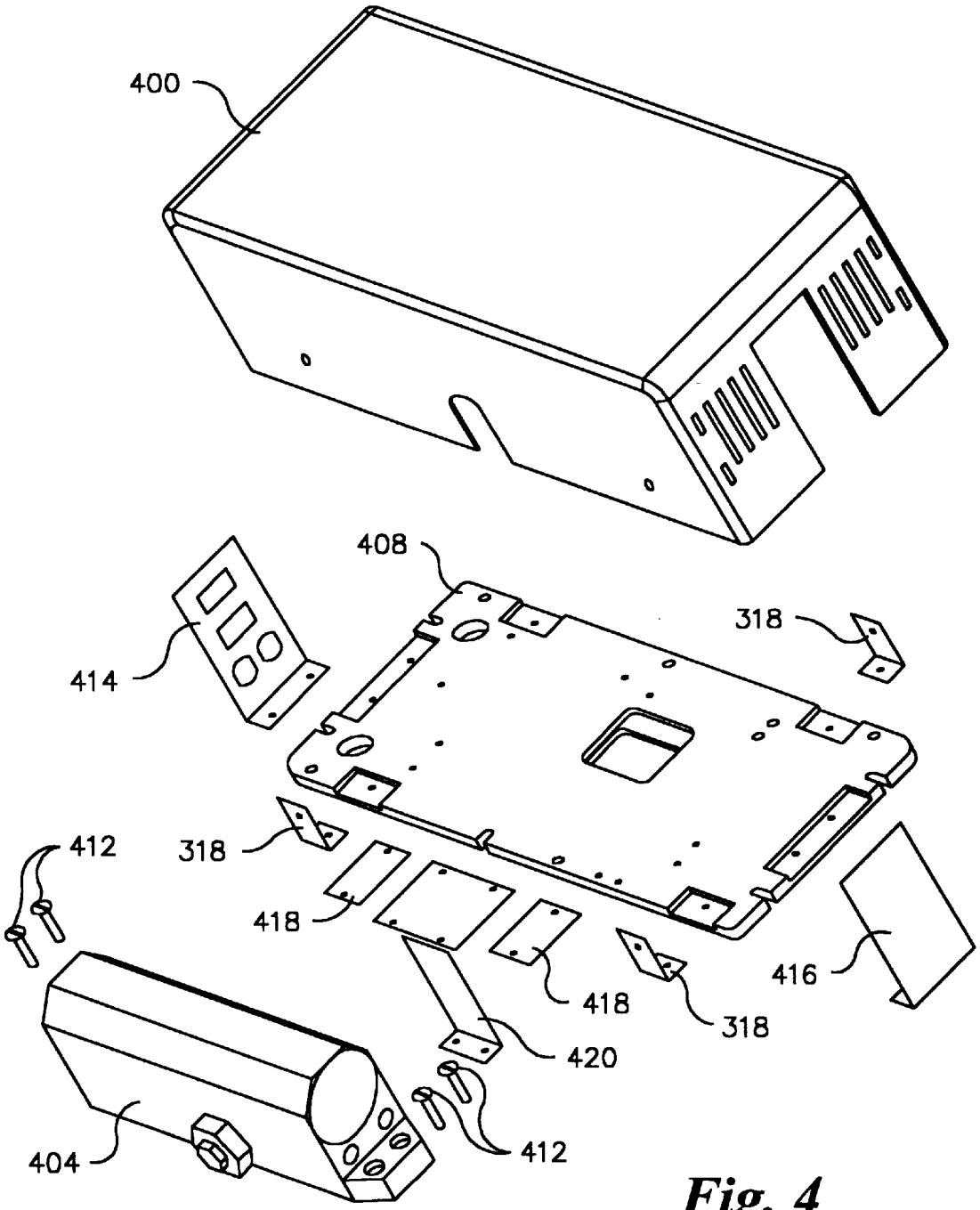
Figure 5A:
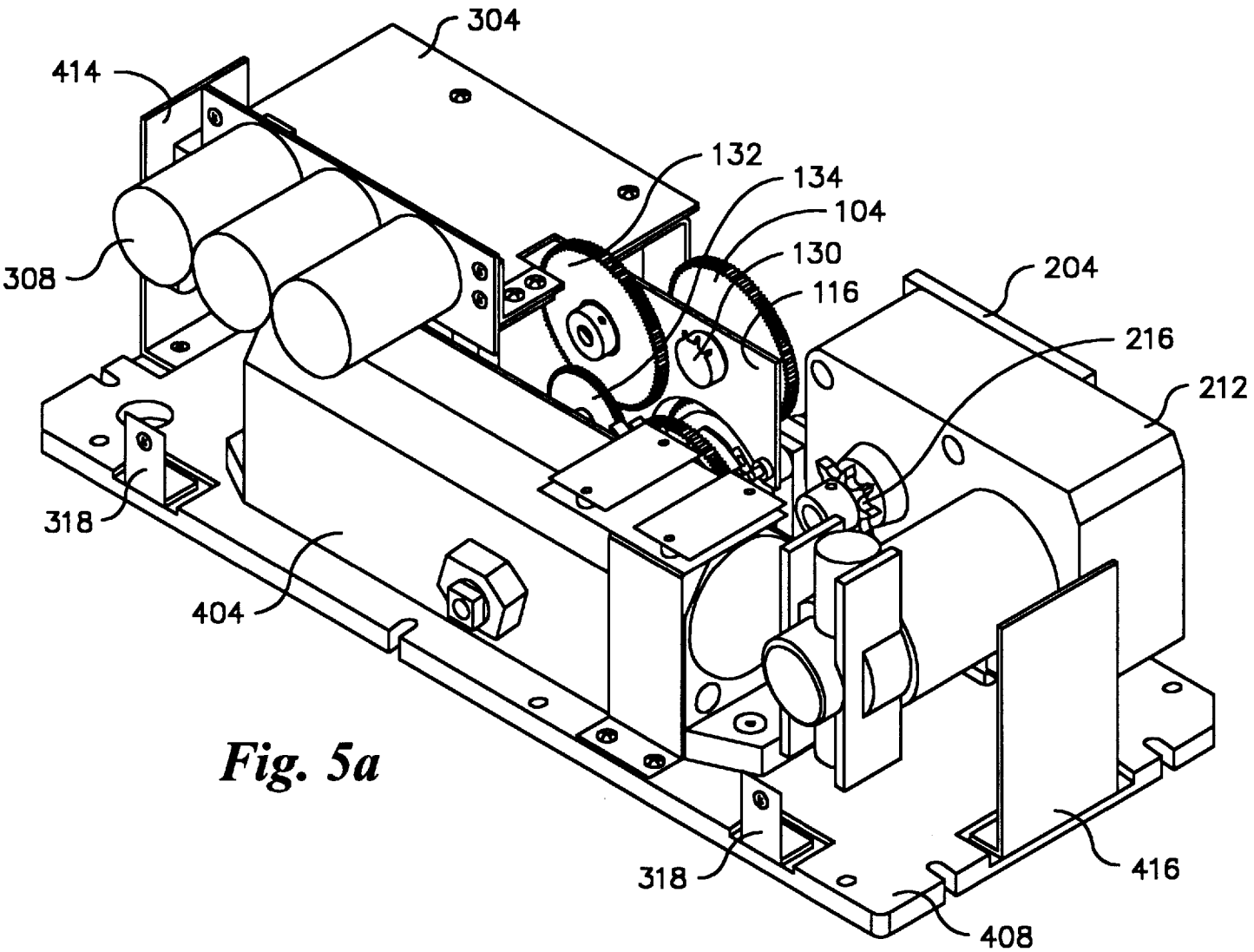
FIGS. 5*a* and *b* are perspective views of the present invention.
Figure 5B:
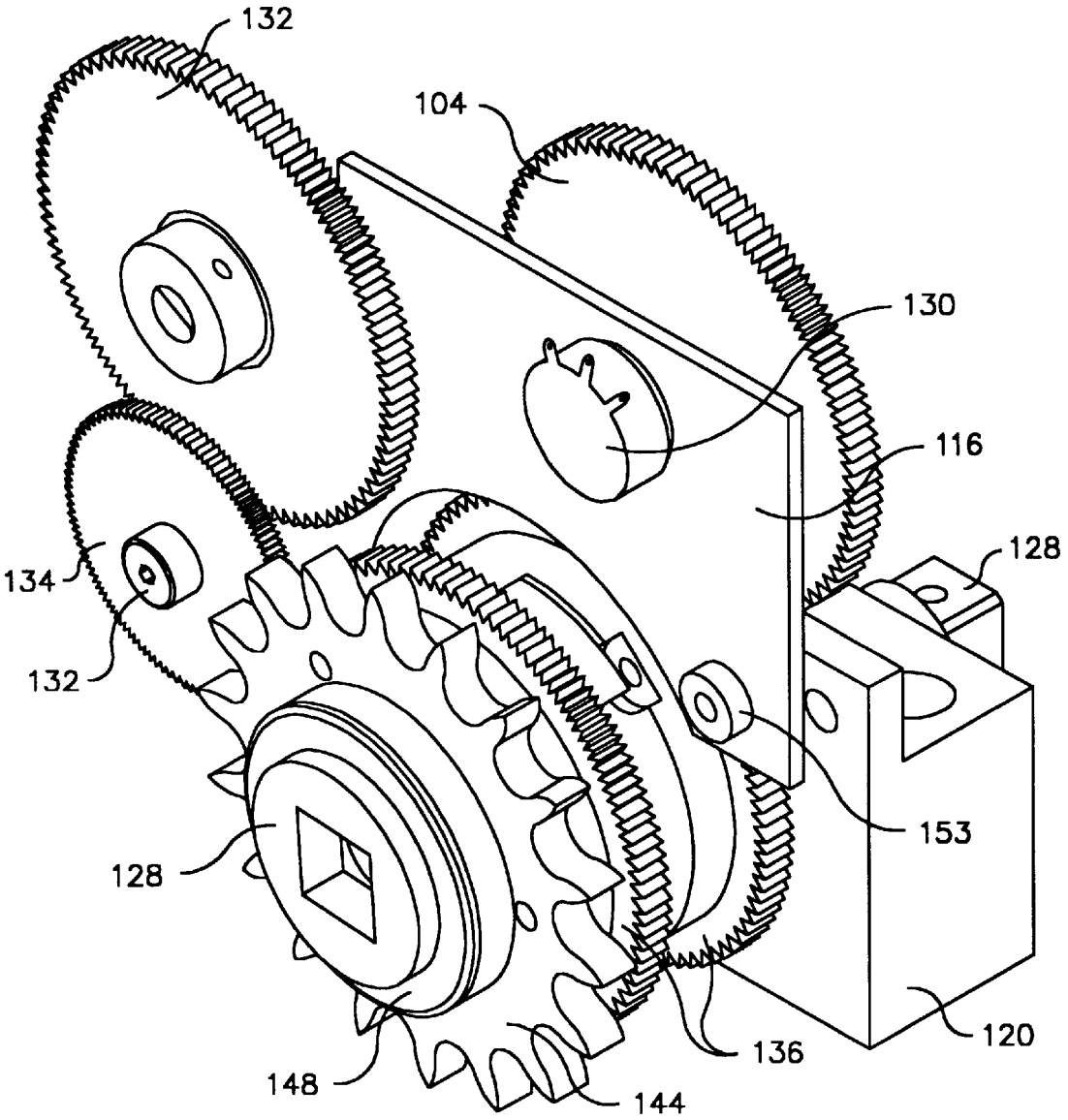
Figure 6:
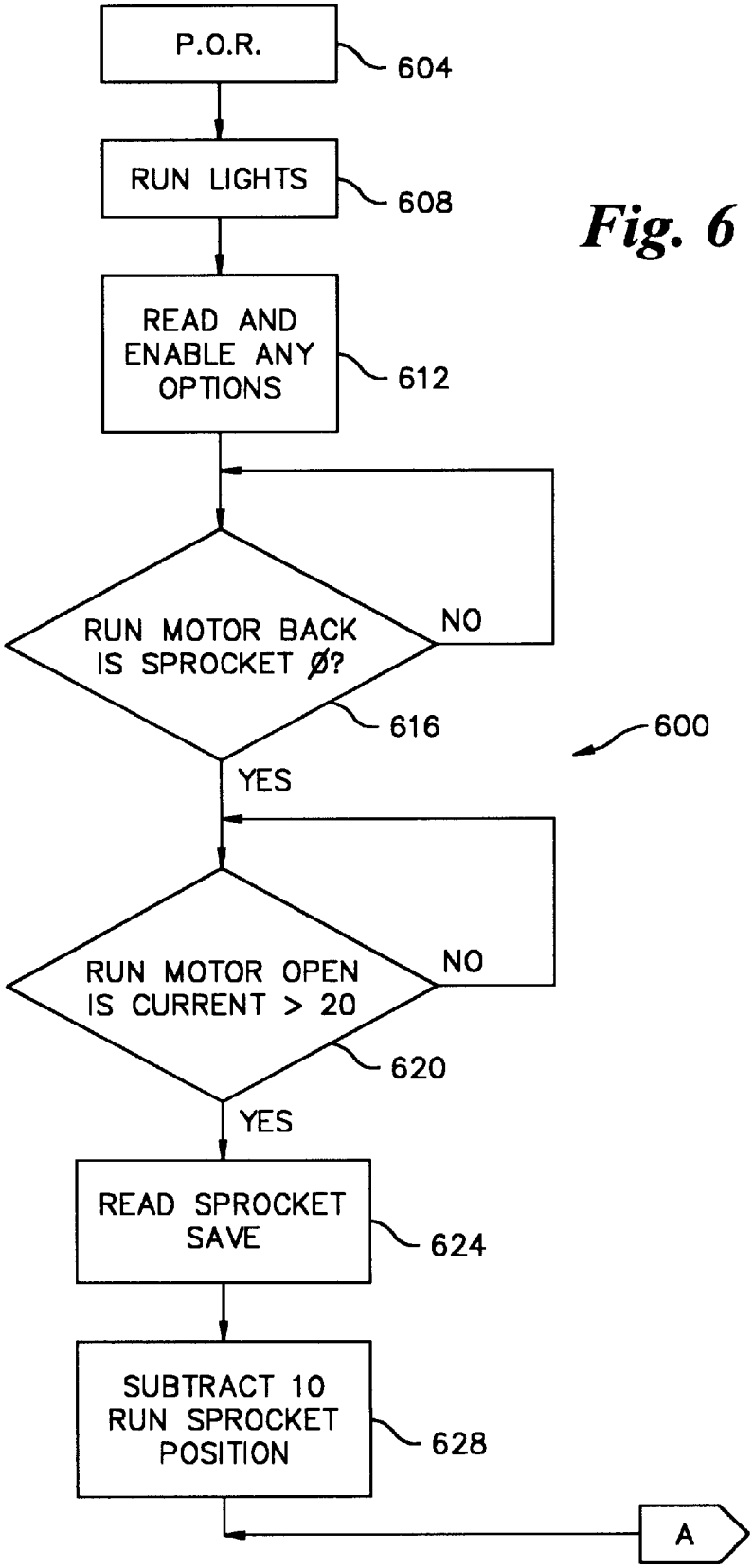
FIGS. 6–10 are flow chart representations of an algorithm suitable for controlling the operations of the door operator system of the present invention.
Figure 7:
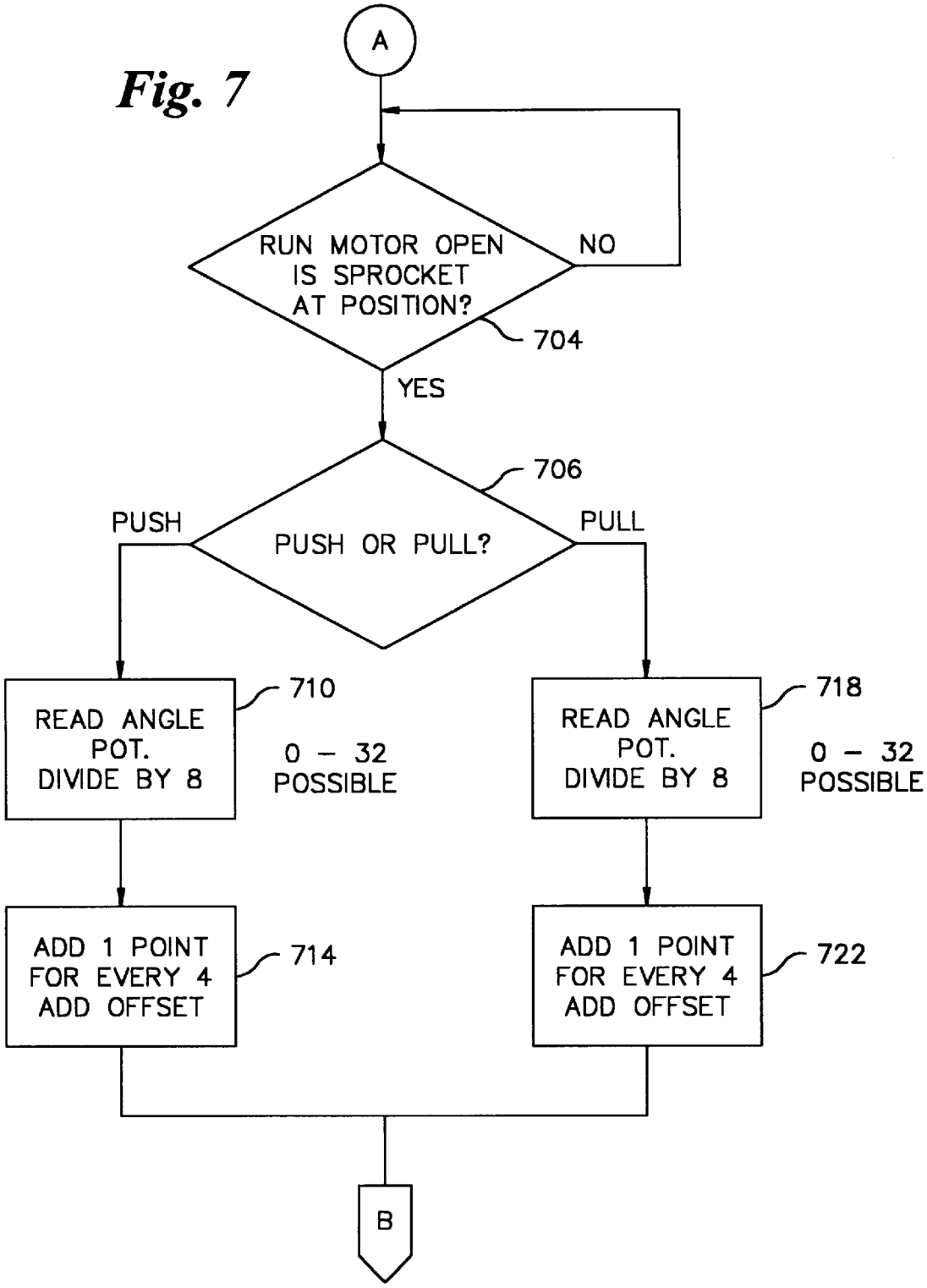

Referring now to FIGS. 1–4 and 5*a* and *b* there are shown exploded views of portions of door operator system 10 of the present invention as well as a perspective view of components of the door operating system 10. Door operating system 10 is useful for moving a door (not shown) by applying a force to the door using an electric motor (not shown) energized by a source of electrical energy (not shown). Door operating system 10 also permits the door to be manually operated by a user. Furthermore, door operating system 10 detects the presence of obstacles in the path of the door and reverses the movement of the door in response thereto.

Door operating system 10 includes gear chain assembly 100 for permitting motor 212 to drive the door according to the method of the present invention as described more fully below. Gear chain assembly 100 includes potentiometers 108, 130. Potentiometers 108, 130 permit independent determinations of the motion of the door and the motion of the motor. Thus, two sources of feedback are provided within door operating system 10. Feedback with respect to the position of the door is provided by potentiometer 130 and feedback with respect to the position of the drive shaft of motor 212 is provided by potentiometer 108.

This permits determining when the door is closed, when the door has been opened far enough while driving it open with the motor, and when the door has reached its home position. Additionally, this eliminates the need for a worker installing door operating system 10 to provide information to system 10 with respect to the home position of the door as also described more fully below. Furthermore, when motor 212 is closing the door this can help prevent overshooting or overtravelling of the door and can permit rapid reopening during the closing process. In the preferred embodiment of system 10, potentiometers 108, 130 can provide two hundred and fifty-six counts during their entire range of travel.

Potentiometer input gears 104, 132 are coupled to potentiometers 108, 130, respectively, in order to drive potentiometers 108, 130 while door operator system 10 is being operated. Potentiometer mounting bracket 116 receives and mounts potentiometers 108, 130 to bearing block 120 for securely holding potentiometers 108, 130 in place while permitting rotational movement of the shafts of potentiometers 108, 130 in response to input force from potentiometer input gears 104, 132.

Potentiometer output gear 136 mounts on sprocket 144 and runs against gear 132 that is coupled to potentiometer 108. In this manner potentiometer 108 is adapted to monitor the travel of intermediate sprocket 144. In order to perform this function potentiometer 108 can be a single turn potentiometer that rotates three hundred degrees while reading six hundred degrees of rotation of sprocket 144. In a similar manner, gear 134, mounted on screw 131 and coupled to potentiometer 130, runs against shaft 128 and allows potentiometer 130 to monitor the movement of the door. When sprocket 144 is run all the way back to its home position the door is in the closed position. When sprocket 144 is run forward the door is moved in the open direction. Sprocket 144 is secured to gear chain assembly 100 by collar 148 and retaining ring 150. Screws 151 attach bearing block 120 to back plate 408 and screws 152 attach the potentiometer mounting bracket 116 to the bearing block 120. The system also provides PEM nuts 153 that are attachment points for screws 152 and 131. Set screws 154 connect gears 104, 132 to the potentiometers 108 and 130.

Intermediate sprocket 144 is provided with drive pin 146 and is adapted to mate with arm base extension 140. Arm base extension 140 is mounted on extension arm shaft 128 in bushing 124 and is provided with square drive dog 142. Intermediate sprocket 144 rotates around drive dog 142 causing drive pin 146 to come into rotating contact with drive dog 142. Drive pin 146 of sprocket 144 thus applies force from motor 212 to drive dog 142 of arm base extension 140 when the door is being opened by door operator system 10. When the door is run forward, drive pin 146 engages drive dog 142 and the current to the windings of motor 212 jumps drastically.

The force applied to arm base extension 140 by intermediate sprocket 144 in this manner provides one way rotatable drive of arm base extension 140. This arrangement between sprocket 144 and arm base extension 140 within system 10 allows motor 212 to drive the door in the opening direction in response to activation of a door opening switch (not shown). It also permits intermediate sprocket 144 to back away freely from arm base extension 140 and maintain pin 146 ahead of drive dog 142 when the motor is reversed and closer 404 is closing the door.

Additionally, the relationship between drive dog 142 and drive pin 146 permits the door to be operated manually without causing rotation of motor 212 and a plurality of elements of gear chain assembly 100. Thus, a user of door operator system 10 can push the door open by hand while motor 212, mounted on bracket 204 having screws 208, and the other parts of gear chain assembly 100 remain stationary. This can extend the life of motor 212 and the parts of gear chain assembly 100 of door operator system 10. For example, it will be understood that closer 404 of system 10 can have a life cycle between two hundred and fifty thousand and five hundred thousand uses. Thus, it is advantageous to permit the door to be opened by hand without moving motor 212 in order to lessen wear on motor 212 whenever the door is pushed open by a user. It will be understood that this advantage is not realized when the push-and-go option is enabled and the motor assists in the movement of the door.

When a user of door operator system 10 again activates the door opening switch after an unassisted manual opening of the door, sprocket 144 again rotates within gear chain assembly 100. As sprocket 144 rotates within gear chain assembly 100 in this manner it again causes drive pin 146 to engage drive dog 142 on arm base extension 140 to drive the door open. Thus, the motion of sprocket 144 is permitted to be independent of the motion of the door when system 10 is not opening the door because of the one way drive capability provided thereby.

It is desirable to permit drive pin 146 of sprocket 144 to dwell very close to drive dog 142 without actually being in contact with it. Thus, drive pin 146 of sprocket 144 is driven until the current of motor 212 jumps and then drive pin 146 is backed off slightly. The door is actually opened slightly by the process so backing off slightly permits it to close.

Door operator system 10 can be housed in an opening cover 400 having a back plate 408 and brackets 414, 416. Closer 404 can be secured to back plate 408 with screws 412. Bracket 414 provides for wire and switch entries. Bracket 416, opposing bracket 414, has no wire or switch entries. The system 10 also provides for circuit boards 418 which includes a radio signal option board and a vestibule entry option board. Bracket 420 provides support for the circuit board 418.

Door operator system 10 of the present invention is also provided with circuit assembly 300 having circuit board 304 mounted on bracket 312 for mounting circuitry useful for the operation of door operator system 10. The circuitry mounted on circuit board 304 includes transformer 316 and a plurality of electrolytic capacitors 308. Electrolytic capacitors may have a capacitance of 30,000–100,000 microfarads. In the preferred embodiment of the present invention, a total of three electrolytic capacitors 308 can be mounted on circuit board 304. However, a greater or smaller number of capacitors 308 can be provided. Bracket 318 is provided for mounting the transformer 316 and capacitors 308 to the cover 400.

It will be understood by those skilled in the art that door operator systems such as door operator system 10 may be required to close the door during a power outage for fire prevention purposes. Thus, capacitors 308 of assembly 300 are permitted to charge and store electrical energy during normal operation of door operator system 10 while the electrical energy source of system 10 applies electrical energy to system 10. A constant trickle charge can be applied to capacitors 308 to keep capacitors 308 fully charged at all times.

When the microprocessor of system 10 determines that power to door operator system 10 has been interrupted, the energy stored in capacitors 308 is applied to motor 212 to energize motor 212 and permit motor 212 to close the door in the absence of externally applied energy. In order to perform this function in the preferred embodiment of the invention, one hundred sixty watts/seconds can be stored in capacitors 308.

Referring now to FIGS. 6–10, there is shown door control algorithm 600. Door control algorithm 600 is useful within system 10 for performing the operations of system 10 set forth herein. When power is applied to door operator system 10 door control algorithm 600 is executed by a microprocessor (not shown) provided within door operator system 10 in a manner well understood by those skilled in the art. The microprocessor can control motor 212 by controlling the frequency and duty cycle of energy signals applied within a pulse width modulation system or by any other well known control method.

When execution of door control algorithm 600 is begun a power on a reset is performed as shown in block 604. The various lights of door operator system 10 are run as shown in blocks 608 and a determination is made whether any options should be executed as shown in block 612. The options that can be performed can include a push-and-go option, a continuous hold option, a vestibule option, a radio operation option and an electrically controlled lock. The options of system 10 can be enabled by jumpers residing on circuitry board 304. The microprocessor controlling the operations of door operator system 10 test for the presence of the various jumpers to determine which options should be run in a manner well known to those skilled in the art.

In decision 616 of algorithm 600, the motor is run back and a determination is made whether sprocket 144 is at its maximum reverse position. If sprocket 144 is not at this maximum position, execution of door control algorithm 600 idles at decision 616 until motor 212 is run back enough to cause sprocket 144 to reach such a position. When sprocket 144 arrives at this position motor 212 is run in the open direction and a determination is made whether the current of motor 212 is greater than a predetermined level as shown in decision 620, indicating that drive pin 146 has encountered drive dog 142. In another embodiment, a determination can be made when the door begins to move. Execution of door control algorithm 600 dwells at decision 620 until the determination of decision 620 is affirmative.

When the determination of decision 620 is affirmative, the position of sprocket 144, as determined by potentiometer 108, is read and saved as shown in block 624. As shown in block 628, ten counts of potentiometer 108 are subtracted from the position of sprocket 144 as determined in block 624. This calculation determines the position where drive pin 146 of sprocket 144 can dwell in order to be close to square drive dog 142 of arm 140 without actually making contact with it as previously described. Execution of door control algorithm 600 then proceeds by way of off-page connector A of FIG. 6 to on-page connector A of FIG. 7.

In decision 704 of door control algorithm 600 a determination is made whether sprocket 144 has reached the position calculated in block 628 above. Execution of door control algorithm 600 dwells at decision 704 until the determination of decision 704 is affirmative. When the determination of decision 704 is affirmative, a determination is made whether door operating system 10 is adapted to push the door open or pull the door open as shown in decision 706. It will be understood by those skilled in the art that door control systems such as door operating system 10 can normally be configured at the time of installation to operate to open a door either by pushing it open from behind or by pulling it open from the front. A worker installing system 10 can indicate this to the microprocessor by setting a configuration switch that can be provided on circuitry board 304.

If a determination is made in decision 706 that door operator system 10 is adapted to push the door open, an angle-setting potentiometer located on circuiting board 304 is read in block 710. The value read in block 710 is divided by eight and an offset can be added to this result as shown in block 714.

If door operator system 10 is adapted to pull the door open, as determined in decision 706, the angle-setting potentiometer is read in block 718 and the resulting value is divided by eight. An offset can be added to this result as shown in block 722. The value read from the angle-setting potentiometer in blocks 710, 718 can correspond to eighty-five to one-hundred fifteen degrees. Execution of door control algorithm 600 then proceeds by way of off-page connector B of FIG. 7 to on-page connector B of FIG. 8.

Whether execution of door control algorithm 600 arrives at on-page connector B by way of blocks 710, 714 or by way of blocks 718, 722, the resulting value calculated from the reading of the angle-setting potentiometer is saved as the target value as shown in block 800. The door position is then read and saved in block 804. The value saved in block 804 indicates the position where the microprocessor of door operator system 10 expects the door to be when it is closed. This closed door position is thus determined during each cycle of door operator system 10. If the door is open far enough beyond this point that the count read from potentiometer 130 is more than two counts beyond the value of block 804, system 10 determines that a push-and-go situation has arisen, wherein the user is beginning to manually open the door. Thus the door position corresponding to the value of block 804 is the push-and-go position.

In decision 808, a determination is then made within door control algorithm 600 whether the door open switch or the continuous switch has been activated. If the door open switch is activated, the door is opened by door operator system 10 for an adjustable period of time. The period of time during which the door is held open and the angle to which the door is opened can be selected using further potentiometers (not shown) on circuitry board 304. The range for the door opening angle can be between eighty-five and one-hundred degrees in the preferred embodiment of the invention. When the adjustable period of time elapses the door is closed.

When the continuous switch is activated the door is opened by door operator system 10 and left open indefinitely. Thus, if the determination of decision 808 is affirmative, the door should be opened and execution of door control algorithm 600 proceeds by way of off-page connector C of FIG. 8 to on-page connector C of FIG. 9 for opening of the door.

If the determination of decision 808 is negative, a determination is made in decision 812 whether the push-and-go option has been enabled as determined in block 812. When this option is enabled system 10 determines whether a user has begun opening the door, wherein the determination is based upon door position rather than the door open switch.

If the push-and-go option has not been enabled execution of door control algorithm 600 returns to decision 808 and idles until some kind of door opening is called for. If the push-and-go option has been enabled, a determination is made in decision 816 whether the position calculated in block 804 has been reached. If the position calculated in block 804 has been reached it is assumed that a user has begun to manually open the door and execution of algorithm 600 proceeds by way of off-page connector C to assist in opening the door. If the position calculated in block 804 has not been reached, execution of algorithm 600 proceeds to decision 808 where algorithm 600 continues to idle.

Figure 8:
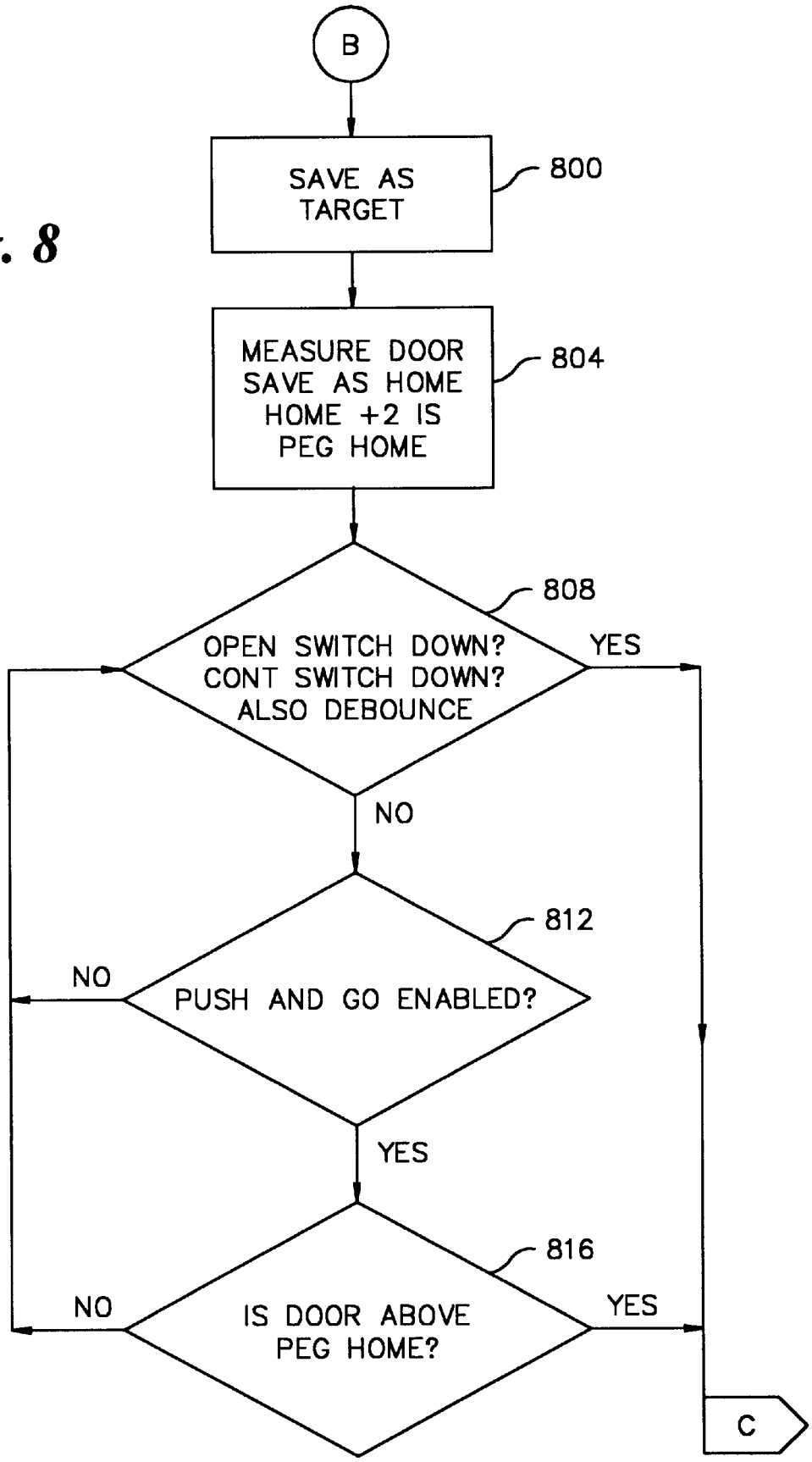
Figure 9:
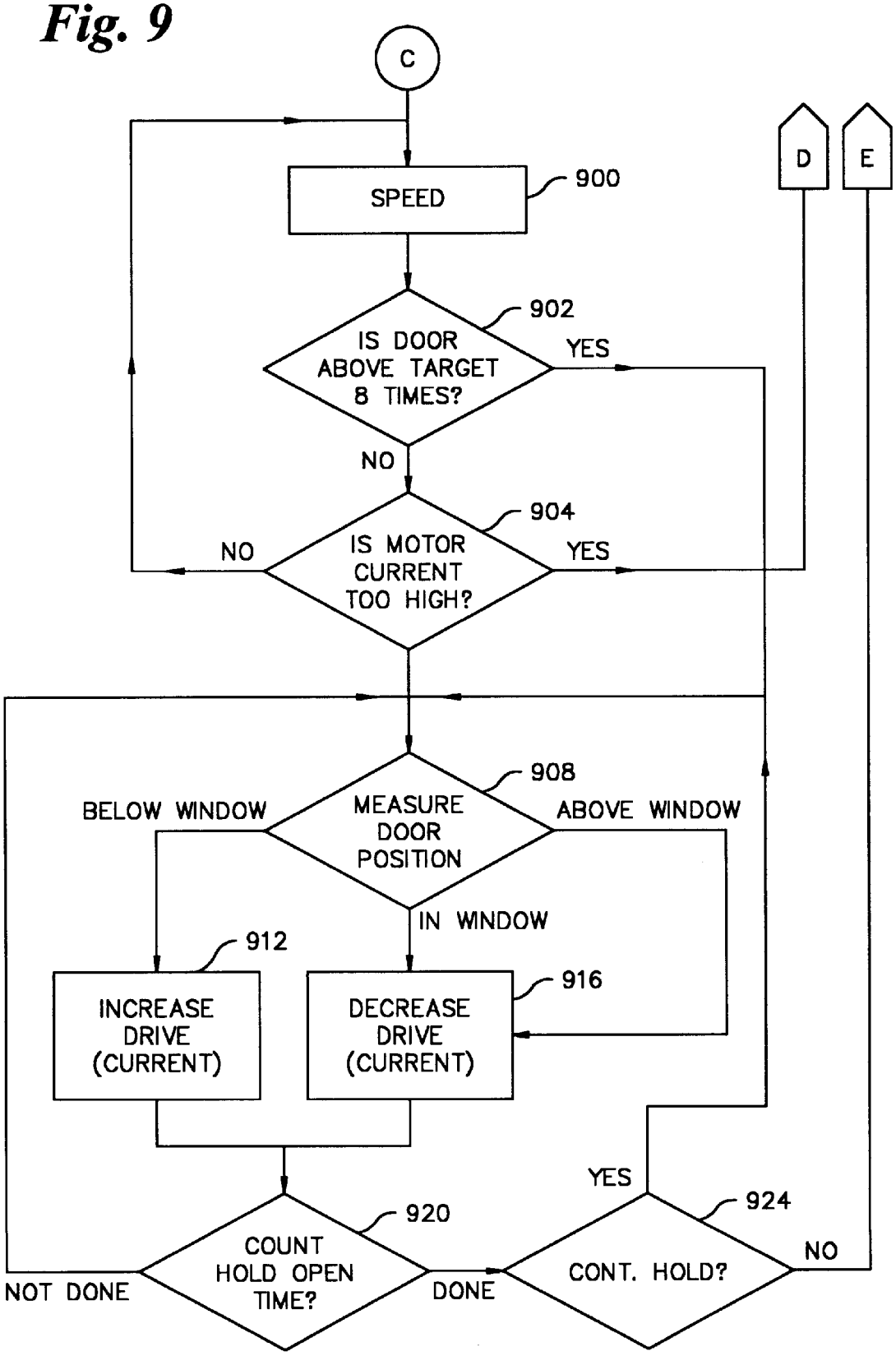

Execution of door control algorithm 600 proceeds from off-page connector C of FIG. 8 to block 900. In block 900 the desired speed motor is read by the microprocessor from a speed-setting potentiometer that can be located on circuitry board 304. When the indicated speed is read from the speed-setting potentiometer, the speed is saved and system 10 can begin opening the door when a reading indicating that the door is opening has been obtained eight consecutive times (decision 902). Requiring eight such readings provides noise immunity.

If the determination of decision 902 is negative the magnitude of the current of motor 212 is determined in decision 904 of door control algorithm 600. If motor 212 current is not too high execution of door control algorithm 600 returns to block 900. Since the door is opening under these conditions, the position reading must be above the target position. Opening of the door continues under these conditions.

If the current of motor 212 is too high, as determined in decision 904, an obstacle is determined to be in the path of door. It is understood by those skilled in the art that when an obstacle causes the door to stop moving, the current in the winding of motor 212 increases because of the increase in the load on motor 212 caused by the obstacle. Under these conditions, execution of door control algorithm 600 proceeds by way of off-page connector D to the door closing portion of door control algorithm 600.

The position of the door is measured in decision 908 and compared against a window. The window is formed by adding and subtracting a few counts from the target position in order to provide a range of permissible positions and prevent oscillation of the door. If the position of the door is determined to be below the window, the drive current of motor 212 is increased as shown in block 912. If the position is above the window or within the window the drive current is decreased as shown in block 916. A determination is then made at decision 920 whether the hold open timer has run. If the hold open timer has not run execution of algorithm 600 returns to decision 908 to again determine the position of the door.

If the hold open timer has run, a determination is made in decision 924 whether the continuous open mode is in effect within door operator system 10. In the preferred embodiment of system 10 the duration of this timer can be adjusted to be between five seconds and five minutes. If the continuous open mode is in effect execution of algorithm 600 returns to decision 908 thereby resetting the door open timer and holding the door open indefinitely. If the continuous open mode is not in effect, execution of door control algorithm 600 proceeds by way of off-page connector E of FIG. 9 to on-page connector E of FIG. 10.

Figure 10:
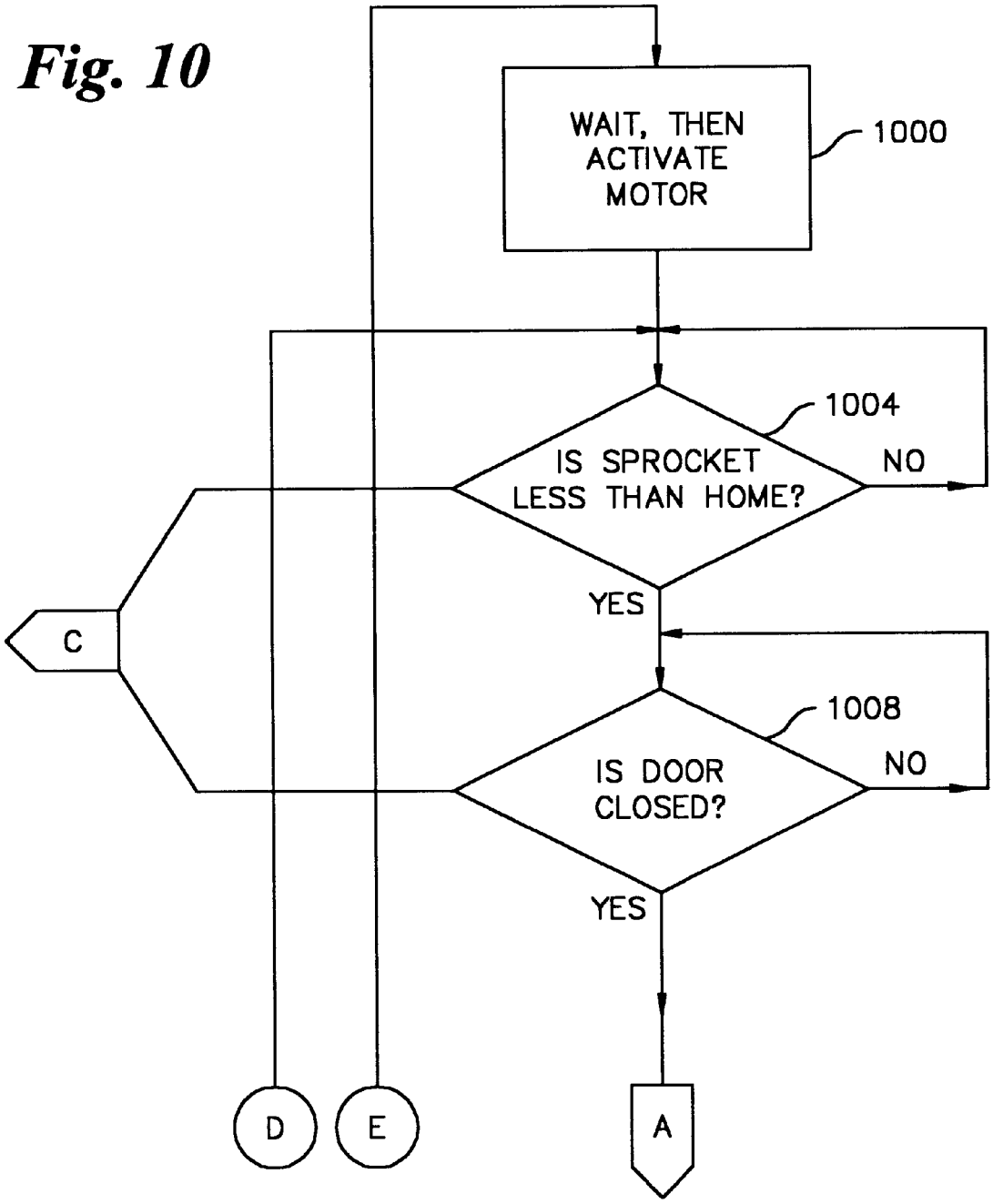

Execution of door control algorithm 600 proceeds from on-page connector E of FIG. 10 to wait block 1000. After the wait determined by block 1000, motor 212 of door operator system 10 is reversed to cause drive pin 146 of sprocket 144 to return to its home position, spaced slightly apart from drive dog 142 of arm base extension 140. The determination when drive pin 146 reaches this position is made in decision 1004. Execution of decision 1004 may be reached either by way of block 1000 or by way of on-page connector D. A determination is then made in decision 1000 whether the door is closed. Execution of door control algorithm 600 then proceeds from FIG. 10 by way of off-page connector A to on-page connector A of FIG. 7, and therefrom to decision 704.

Figure 11A:
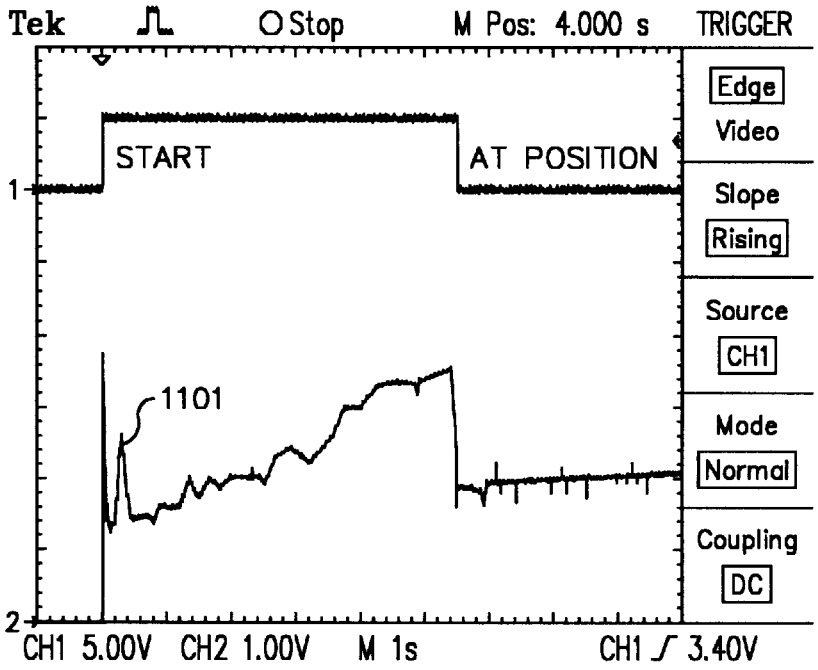
FIGS. 11*a–d* are graphical representations of the relationship between the motor current of the door operator system of the present invention and time.
Figure 11B:
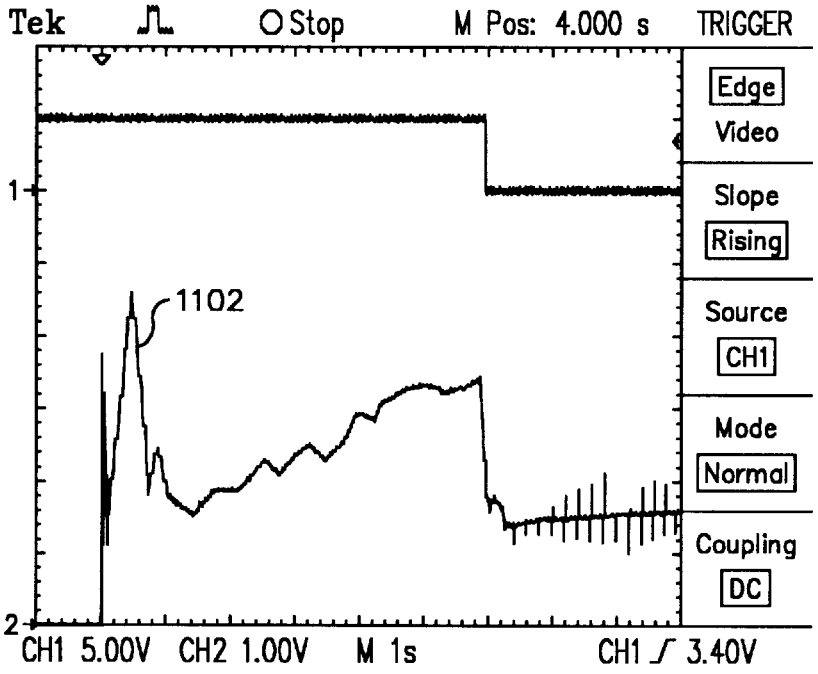
Figure 11C:
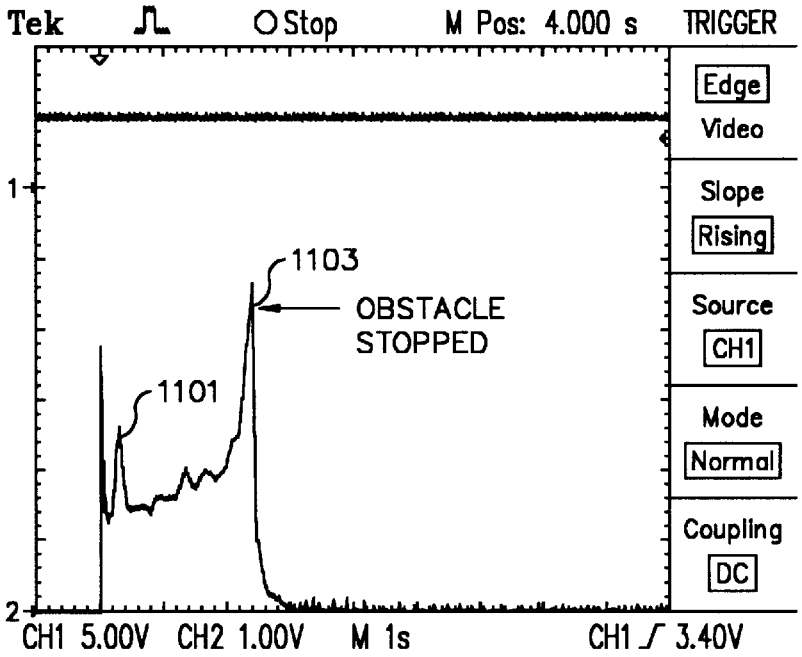
Figure 11D:
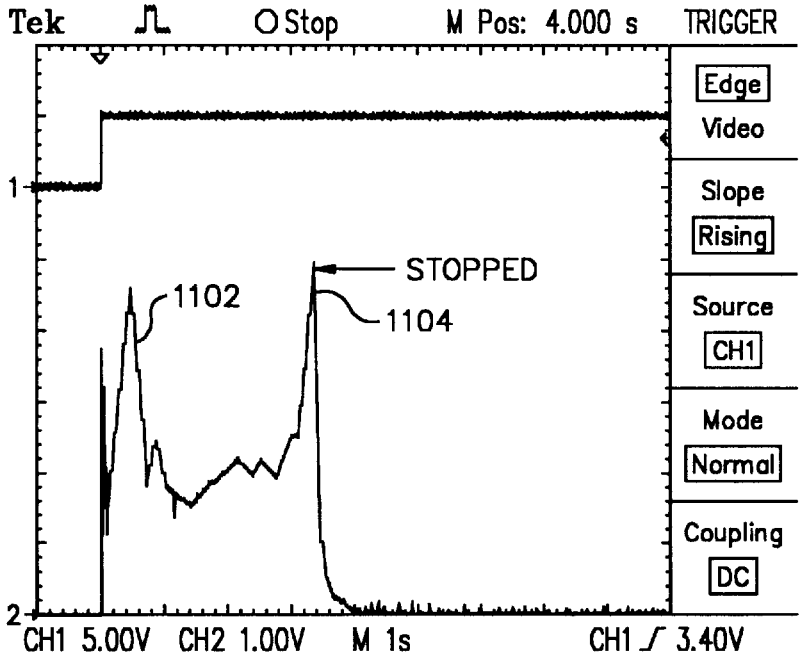

FIGS. 11*a–d* are graphical representations of the relationship between the motor current of the door operating system 10 of the present invention and time. In FIG. 11*a*, there are no obstacles and peak 1101 represents voltage generated by the current to open a 40 lb door. FIG. 11*b* illustrates a graph where there is no obstacle and peak 1102 represents voltage generated by the current to open a 150 lb door. FIG. 11*c* shows peak 1101 which is the voltage generated to open a 40 lb door and peak 1103 which is an 8 lb obstacle. FIG. 11*d* shows peak 1102 which represents the voltage generated to open a 150 lb door and peak 1104 which is a 10 lb obstacle.

At each point in the travel of the door, the microprocessor can store an instantaneous current value as shown in FIGS.

11*a–d*. For example, 64 to 256 values can be stored for each opening cycle. Furthermore, the value of a number of such opening cycles can be saved and averaged to provide a set of reference values. For example, the 8 previous cycles can be averaged. The present readings during an opening cycle can then be compared against the reference values to provide an accurate indication of whether an obstacle has been encountered.

Obviously, numerous modifications and variations of the present invention are possible in light of the above teachings. It is therefore to be understood that within the scope of the claims appended hereto, the invention may be practiced otherwise than as specifically disclosed herein.

What is claimed is:

1. A door operating system for controlling the movement of a door, the system having a motor with a motor shaft for providing rotational energy to the system and a gear chain assembly for receiving the rotational energy from the motor shaft and applying the received rotational energy to the door to move the door, comprising;

a sprocket rotatably mounted on the gear chain assembly for rotation around an axis of the gear chain assembly and fixedly coupled to the motor shaft for receiving and transmitting the rotational energy from the motor shaft;

a drive pin fixedly disposed on the sprocket for rotational movement around the axis of the gear chain assembly as the sprocket rotates around the axis;

a rotational energy receiving extension rotatably mounted on the gear chain assembly and drivingly coupled to the door for moving the door;

a drive dog fixedly disposed on the energy receiving extension for rotational movement around the axis of the gear chain assembly as the energy receiving extension rotates around the axis; and the sprocket and the extension being disposed on the gear chain assembly such that rotational movement of the sprocket causes the drive pin to rotatably move into contact with the drive dog and apply rotational energy to the drive dog thereby transmitting rotational energy to the door when rotating in one direction and moving away from the drive dog when rotating in the other direction.

* * * * *